US008744285B2

(12) United States Patent
Akiyoshi

(10) Patent No.: US 8,744,285 B2
(45) Date of Patent: Jun. 3, 2014

(54) IMAGE FORMING DEVICE, DOCUMENT PROCESSING METHOD, AND RECORDING MEDIUM

(75) Inventor: Kunihiro Akiyoshi, Fukuoka (JP)

(73) Assignee: Ricoh Company, Ltd., Tokyo (JP)

( * ) Notice: Subject to any disclaimer, the term of this patent is extended or adjusted under 35 U.S.C. 154(b) by 635 days.

(21) Appl. No.: 13/023,597

(22) Filed: Feb. 9, 2011

(65) Prior Publication Data

US 2011/0206434 A1 Aug. 25, 2011

(30) Foreign Application Priority Data

Feb. 19, 2010 (JP) ..... 2010-035174

(51) Int. Cl.
*G03G 15/00* (2006.01)

(52) U.S. Cl.
CPC ..... *G03G 15/00* (2013.01)
USPC ..... 399/19; 399/18

(58) Field of Classification Search
USPC ..... 399/19
See application file for complete search history.

(56) References Cited

U.S. PATENT DOCUMENTS

| | | | | |
|---|---|---|---|---|
| 5,684,934 | A * | 11/1997 | Chen et al. | 358/1.14 |
| 6,208,436 | B1 * | 3/2001 | Cunningham | 358/474 |
| 7,460,255 | B2 * | 12/2008 | Kizaki | 358/1.13 |
| 7,619,792 | B2 * | 11/2009 | Itagaki et al. | 358/504 |
| 7,862,029 | B2 * | 1/2011 | Yokobori et al. | 271/3.14 |
| 8,040,535 | B2 * | 10/2011 | Kurahashi et al. | 358/1.12 |
| 2003/0133721 | A1 * | 7/2003 | Brewington | 399/19 |
| 2004/0158655 | A1 * | 8/2004 | Kremer | 710/8 |
| 2005/0168767 | A1 * | 8/2005 | Moroney et al. | 358/1.14 |
| 2006/0066888 | A1 | 3/2006 | Uemura | |
| 2007/0229923 | A1 * | 10/2007 | Itagaki et al. | 358/504 |
| 2007/0274751 | A1 * | 11/2007 | Ushio | 399/382 |
| 2009/0127778 | A1 * | 5/2009 | Obuchi et al. | 271/303 |
| 2009/0148069 | A1 * | 6/2009 | Inoha et al. | 382/305 |

FOREIGN PATENT DOCUMENTS

| | | | |
|---|---|---|---|
| JP | 09-179362 | A | 7/1997 |
| JP | 2006-099154 | A | 4/2006 |
| JP | 2007-302355 | | 11/2007 |

OTHER PUBLICATIONS

Japanese Office Action dated Aug. 20, 2013.

* cited by examiner

*Primary Examiner* — Anthony Nguyen
(74) *Attorney, Agent, or Firm* — IPUSA, PLLC

(57) ABSTRACT

An image forming device includes a controller, a printer, first and second sheet feeding parts, and a document sheet ejection part. The controller includes an image acquiring unit which acquires image data, a document transport control unit which controls transporting of document sheets in the first sheet feeding part so that the document sheets are sequentially fed from the first sheet feeding part and delivered to the document sheet ejection part, and a print control unit. When one of the document sheets associated with a specified page is fed from the first sheet feeding part, the print control unit controls the document transport control unit so that a sheet is fed from the second sheet feeding part to the printer, and the printing control unit causing the printer to print the image data on the sheet and deliver the printed sheet to the document sheet ejection part.

15 Claims, 4 Drawing Sheets

IMAGE FORMING DEVICE, DOCUMENT PROCESSING METHOD, AND RECORDING MEDIUM

BACKGROUND OF THE INVENTION

1. Field of the Invention

The present disclosure relates to an image forming device, a document processing method, and a recording medium which are adapted to perform document processing for a plurality of document sheets.

2. Description of the Related Art

When a plurality of document sheets are printed out by an image forming device using a copy function or a print function thereof, there may be a case in which misprints of document sheets of some pages therein are discovered and replacement of them with correction sheets is needed. There may be another case in which, after the plurality of document sheets are printed, addition of some new document sheets to the plurality of document sheets or removal of the document sheets of some pages from the same is needed.

In such cases, it has been necessary for a user of an image forming device according to the related art to perform document processing of addition, removal or replacement of some sheets by manual operation. For example, refer to Japanese Laid-Open Patent Publication No. 2007-302355.

However, when a large number of document sheets are printed or when a large number of document sheets have to be replaced, the document processing work becomes very complicated. In many cases, for the sake of reducing the burden of the document processing work, the printing of all the document sheets after the document processing is completed will be repeated. The repeated printing of the same document sheets including the pages that have not been corrected will increase the waste of recording sheets, and this is not desirable from the viewpoints of cost reduction and resource savings.

SUMMARY OF THE INVENTION

In one aspect, the present disclosure provides an image forming device, a document processing method, and a recording medium which are capable of easily and efficiently performing the document processing of addition, removal or replacement to correct some document sheets among a plurality of document sheets.

In an embodiment which solves or reduces one or more of the above-mentioned problems, the present disclosure provides an image forming device including a controller, a printer, a first sheet feeding part, a second sheet feeding part, and a document sheet ejection part, the controller including: an image acquiring unit to acquire image data; a document transport control unit to control transporting of document sheets in the first sheet feeding part so that the document sheets are sequentially fed from the first sheet feeding part and delivered to the document sheet ejection part; and a print control unit to control, when one of the document sheets associated with a specified page is fed from the first sheet feeding part, the document transport control unit so that a sheet is fed from the second sheet feeding part to the printer, and the printing control unit causing the printer to print the image data, acquired by the image acquiring unit, on the sheet and deliver the printed sheet to the document sheet ejection part.

Other objects, features and advantages of the present disclosure will become more apparent from the following detailed description when read in conjunction with the accompanying drawings.

DETAILED DESCRIPTION OF THE PREFERRED EMBODIMENTS

A description will be given of embodiments of the present disclosure with reference to the accompanying drawings.

Figure 1:
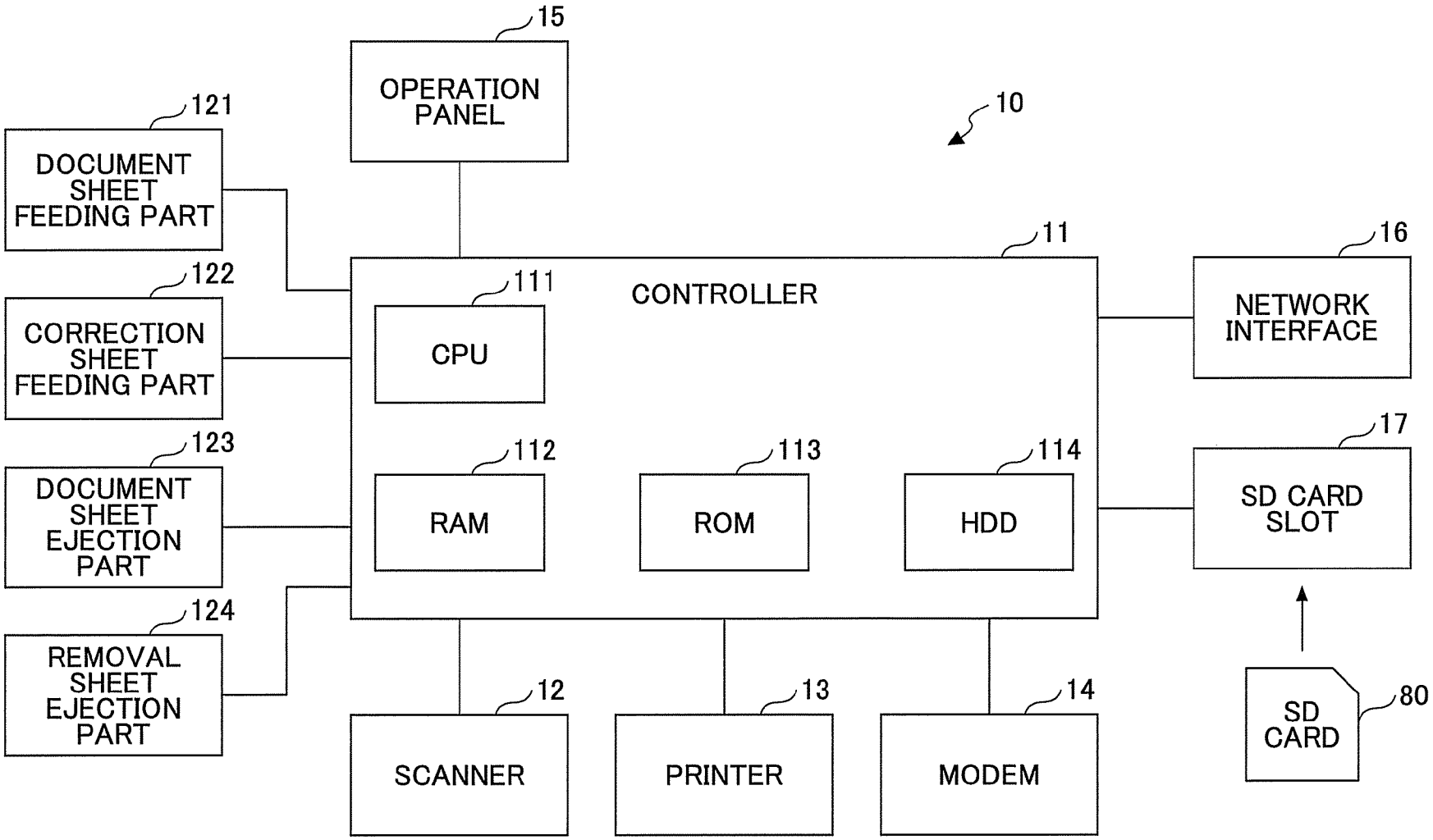
FIG. 1 is a diagram illustrating the hardware composition of an image forming device of an embodiment of the present disclosure.

FIG. 1 illustrates the hardware composition of an image forming device of an embodiment of the present disclosure. As illustrated in FIG. 1, the image forming device 10 of this embodiment includes a controller 11, a scanner 12, a printer 13, a modem 14, an operation panel 15, a network interface 16, an SD card slot 17, a document sheet feeding part 121, a correction sheet feeding part 122, a document sheet ejection part 123, and a removal sheet ejection part 124 as the hardware components thereof.

The controller 11 includes a CPU 111, a RAM 112, a ROM 113, and a HDD 114. The ROM 113 stores various kinds of programs and various kinds of data used by the programs. The RAM 112 is used as a storage area in which a program is loaded, and used as a work area which is used by the loaded program. The CPU 111 executes the program loaded in the RAM 112 and carries out one of the functions of the image forming device 10 by the execution of the program. The HDD 114 stores various kinds of programs and various kinds of data used by the programs.

The scanner 12 is a hardware component (an image reading unit) for reading image data from a document. The printer 13 is a hardware component (a printing unit) for printing print data on a recording sheet. The modem 14 is a hardware component for connecting the image forming device 10 to a telephone line. The modem 14 is used to perform the transmitting/receiving of image data by FAX communication. The operation panel 15 is a hardware component which is provided with an input unit including input buttons for receiving a user input from a user who has operated the input buttons, and a display unit, such as a liquid crystal panel, for displaying operational messages on the image forming device 10. The network interface 16 is a hardware component for connecting the image forming device 10 to a network, such as a LAN, (which may be a wireless network or a wired network). The SD card slot 17 is used to read out a program recorded on an SD card 80. Namely, in the image forming device 10, not only the program recorded on the ROM 113 but also the program recorded on the SD card 80 may be read out and loaded to the RAM 112 so that the program loaded to the RAM 112 is executable.

Alternatively, the SD card 80 may be replaced with another recording medium (for example, a CD-ROM or a USB (universal serial bus) memory). That is, the kind of a recording medium equivalent to the SD card 80 is not limited to this embodiment. In such a case, the SD card slot 17 may be replaced with a hardware component in conformity with the kind of the recording medium.

The document sheet feeding part 121, the correction sheet feeding part 122, the document sheet ejection part 123, and the removal sheet ejection part 124 in the image forming device of this embodiment will be described with reference to FIG. 2.

Figure 2:
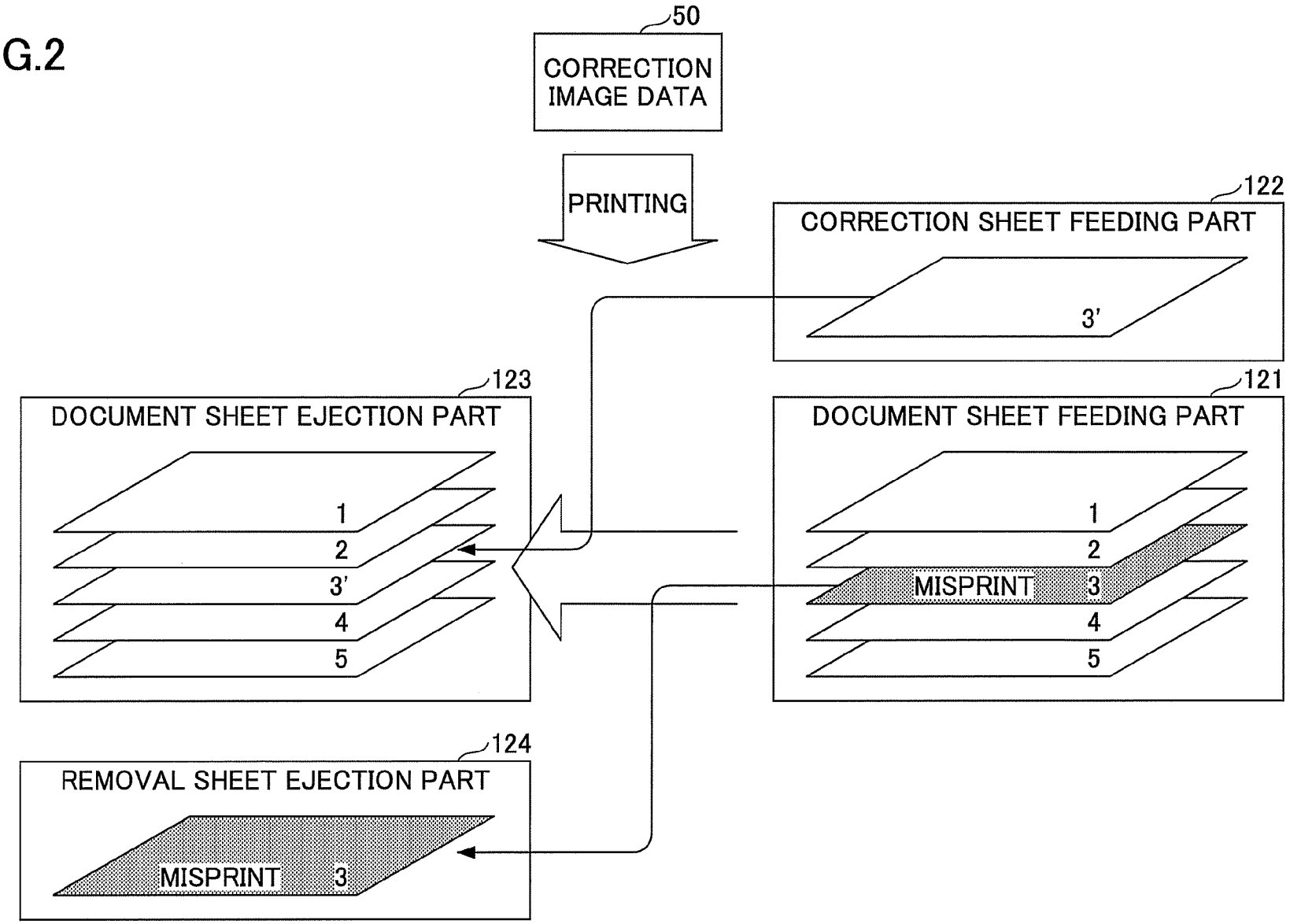
FIG. 2 is a diagram for explaining the function of document processing which is performed by the image forming device of the present embodiment.

FIG. 2 is a diagram for explaining the function of document processing which is performed by the image forming device of this embodiment. In this embodiment, the image forming device 10 carries out document processing of addition, removal or replacement of some document sheets among a plurality of document sheets (which may be printouts or handwritten documents). Typically, in the example of FIG. 2, the way the document processing of replacement is performed by the image forming device 10 is illustrated.

The document sheet feeding part 121 is a hardware component (for example, a tray) in which a plurality of paper documents (or document sheets) which are subjected to document processing are arranged. In the example of FIG. 2, document sheets of five pages which contain a misprint in the document sheet of the third page are arranged in the document sheet feeding part 121.

The correction sheet feeding part 122 is a hardware component (for example, a tray) in which one or more recording sheets (blank recording sheets or correction sheets) on which correction image data 50 is printed at the time of addition or replacement are arranged. The correction image data 50 may be read out by the scanner 12 at the time of addition or replacement. Alternatively, the correction image data 50 may be stored beforehand in the HDD 144 or in an external storage device connected to the image forming device 10 via a network.

The document sheet ejection part 123 is a hardware component (for example, a tray) to which the recording sheets (document sheets) fed from the document sheet feeding part 121 are delivered. However, at the time of replacement or removal, the document sheets containing pages subjected to the replacement or the removal are delivered to the removal sheet ejection part 124. In the case of the replacement, one or more correction sheets are fed from the correction sheet feeding part 122, and the correction sheets (or correction image pages) on which the correction image data 50 is printed are delivered to the document sheet ejection part 123.

In the example of FIG. 2, the document sheet of the third page containing the misprint therein is delivered to the removal sheet ejection part 124, while the correction image page is delivered to the document sheet ejection part 123 as the corrected document sheet of the third page.

Figure 3:
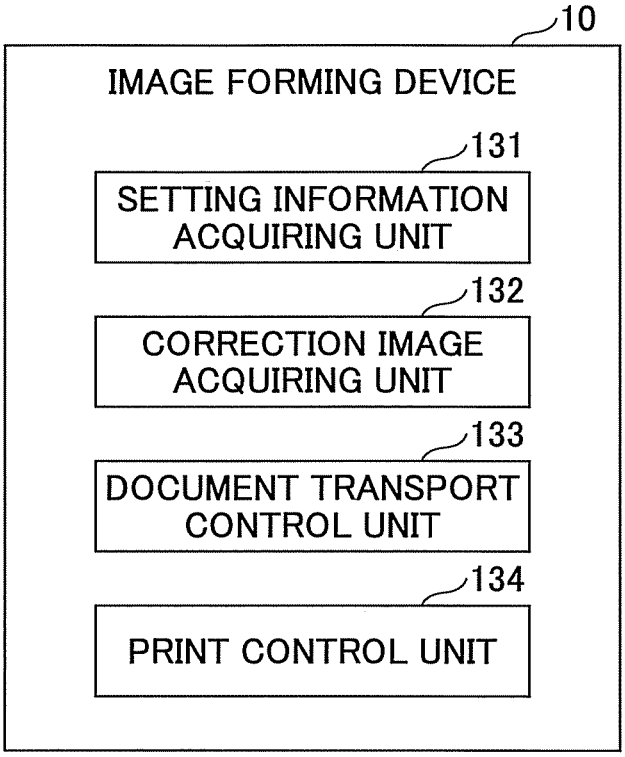
FIG. 3 is a diagram illustrating the functional composition of a controller of the image forming device of the present embodiment.

In order to carry out the function of the document processing, the controller 11 of the image forming device 10 of this embodiment is arranged to have the functional composition illustrated in FIG. 3. FIG. 3 illustrates the functional composition of the controller of the image forming device of this embodiment.

As illustrated in FIG. 3, the controller 11 of the image forming device 10 includes a setting information acquiring unit 131, a correction image acquiring unit 132, a document transport control unit 133, and a print control unit 134.

The setting information acquiring unit 131 acquires setting information and stores the setting information in the RAM 112. The setting information may be acquired through the operation panel 15, or may be acquired from the HDD 114. In the case in which the setting information is acquired through the operation panel 15, the user is requested to set the setting information at the time of correction of the document sheets. In the case in which the setting information is acquired from the HDD 114, the setting information is set up and stored beforehand in the HDD 114.

For example, the setting information contains items of information, including a correction type, a correction page, the number of sheets, page information, and a correction image data providing source. The correction type is an indicator indicating one of addition, removal, and replacement of the document processing. The correction page is a page number indicating a page subjected to the correction in the document processing. When correcting document sheets of two or more pages, a page number of each of the two or more pages is specified. The number of sheets is the number of document sheets. When correcting a plurality of document sheets, the number of sheets is used to distinguish each document sheet. Hence, when a single document sheet is to be corrected, it is not necessary to specify the number of sheets in the setting information.

Furthermore, in the setting information described above, the page information is information indicating that double-sided printing or intensive printing is specified for the document sheets. Namely, the page information is information used to determine the association between each document sheet and the page number. For example, in the case of double-sided printing (with no intensive printing), it is assumed that each of the document sheets contains image data of 2 pages. In the case of intensive printing (with no double-sided printing), it is assumed that each of the document sheets contains image data of the pages which are subjected to the intensive printing. In the case of both-sided printing and intensive printing, it is assumed that each of the document sheets contains image data of the pages corresponding to the intensive printing number multiplied by 2. When intensive printing of the document sheets is performed, the intensive printing number is also specified in the page information.

However, when the document sheets are subjected to one-side printing and not subjected to intensive printing, it is not necessary to specify the page information in the setting information.

Furthermore, in the setting information described above, the correction image data providing source is information which indicates a data providing source of the correction image data 50. As described above, the data providing source of the correction image data 50 may include the scanner 12, the HDD 114, and the external storage device. When the data providing source is the scanner 12, the information indicating the data providing source is an identifier which indicates the scanner 12. When the data providing source is the HDD 114 or the external storage device, the information indicating the data providing source is the address information of a file in which the correction image data 50 is stored (a filename or a URL (uniform resource locator)).

In the image forming device 10 of this embodiment, the correction image acquiring unit 132 acquires the correction image data 50 from the data providing source specified in the setting information. The document transport control unit 133 controls the transporting of the document sheets arranged in the document sheet feeding part 121 such that the document sheets are sequentially fed from the document sheet feeding part 121 and delivered to the document sheet ejection part 123. Similarly, the document transport control unit 133 controls the transporting of one or more correction sheets arranged in the document sheet feeding part 122 such that the one or more correction sheets are sequentially fed from the correction sheet feeding part 122, and subsequently, after the printing of the correction image data onto each correction sheet is performed, the correction sheet is delivered to the document sheet ejection part 123.

When the correction type is removal or replacement, in the image forming device 10 of this embodiment, if one of the document sheets of the document sheet feeding part 121 associated with the correction page specified in the setting information is fed from the document sheet feeding part 121, the document transport control unit 133 delivers the document sheet (or the removal sheet) to the removal sheet ejection part 124. The print control unit 134 causes the correction sheet feeding part 122 to feed the correction sheet to the printer 134 when the document sheets being delivered by the document transport control unit 133 contain the correction page specified in the setting information. The print control unit 134 controls the printer 13 so that the correction image data 50 acquired by the correction image acquiring unit 132 is printed on the correction sheet. The print control unit 134 controls the printer 13 so that the correction sheet on which the correction image data 50 is printed is delivered to the document sheet ejection part 123.

Figure 4:
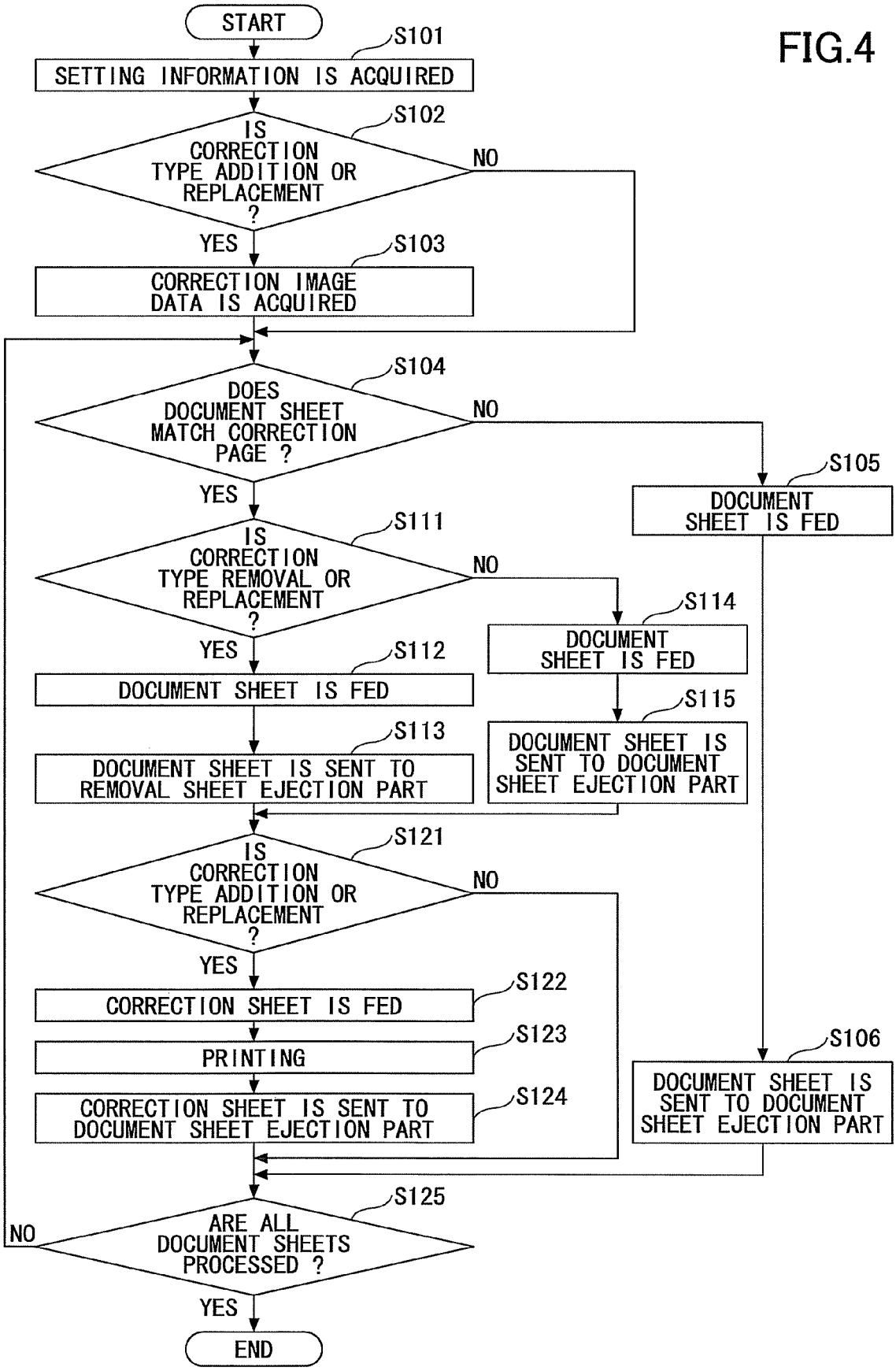
FIG. 4 is a flowchart for explaining the document processing which is performed by the image forming device of the present embodiment.

Next, the document processing which is performed by the image forming device 10 of this embodiment will be described. FIG. 4 is a flowchart for explaining the document processing which is performed by the image forming device of the present embodiment.

If a user input indicating a document processing start command is input by an operator (for example, a start key in the operation panel is depressed), the document processing in the flowchart of FIG. 4 is started.

In step S101 in the flowchart of FIG. 4, the setting information acquiring unit 131 acquires the setting information and stores the setting information in the RAM 112.

Subsequently, the correction image acquiring unit 132 accesses the setting information stored in the RAM 112 and determines whether the correction type specified in the setting information indicates addition or replacement (S102).

When it is determined in the step S102 that the correction type indicates addition or replacement, the correction image acquiring unit 132 acquires the correction image data 50 from the data providing source specified in the setting information (S103).

When the data providing source specified in the setting information indicates the scanner 12, the correction image acquiring unit 132 causes the scanner 12 to perform the reading of correction image data 50 from a correction document sheet which is placed in a predetermined position of the image forming device 10 (which is, for example, the ADF (automatic document feeder) or the document base contact glass). When a plurality of correction document sheets are placed in the predetermined position, the correction image acquiring unit 132 acquires a plurality of items of correction image data 50 from the correction document sheets respectively.

When the data providing source specified in the setting information indicates the HDD 114 or the external storage device, the correction image acquiring unit 132 acquires the correction image data 50 from a file indicated by the address information of the data providing source. When a plurality of data providing sources (filenames, etc.) are indicated by the address information of the data providing source, the correction image acquiring unit 132 acquires a plurality of items of correction image data 50 from the data providing sources respectively.

Subsequently, the correction image acquiring unit 132 stores the acquired correction image data 50 in the RAM 112.

When both-sided printing or intensive printing is performed, the image data of other pages which are contained in the same document sheet are also acquired by the correction image acquiring unit 132.

On the other hand, when it is determined in the step S102 that the correction type indicates removal, the step S103 is not performed and the control is transferred to the next step S104.

Subsequently, in the step S104, the document transport control unit 133 determines whether a document sheet currently delivered from the document sheet feeding part 121 (which is referred to as "current document sheet") matches the correction page specified in the setting information.

Specifically, whenever the step S104 is performed, the document transport control unit 133 increments a value of an internal counter (the initial value of which is set to 0) which holds the identification number of the current document sheet, and compares the counter value with the correction page specified in the setting information. In the case of one-side printing (with no intensive printing), when the counter value matches the correction page, it is determined that the current document sheet is the correction page. In the case of both-sided printing or intensive printing, the both-sided printing number or the intensive printing number is taken into consideration and it is determined in the step S104 whether the current document sheet contains the correction page. When the value of the counter exceeds the number of sheets specified in the setting information, the value of the counter is set to 1.

When it is determined in the step S104 that the current document sheet does not match the correction page, the document transport control unit 133 causes the document sheet feeding part 121 to feed the current document sheet (S105). Subsequently, the document transport control unit 133 delivers the current document sheet to the document sheet ejection part 123 without performing a printing job (S106).

On the other hand, when it is determined in the step S104 that the current document sheet matches the correction page, the document transport control unit 133 accesses the setting information and determines whether the correction type specified in the setting information indicates removal or replacement (S111).

When it is determined in the step S111 that the correction type indicates removal or replacement, the document transport control unit 133 causes the document sheet feeding part 121 to feed the current document sheet (S112). Subsequently, the document transport control unit 133 delivers the current document sheet to the removal sheet ejection part 124 without performing a printing job (S113).

On the other hand, when it is determined in the step S111 that the correction type does not indicate removal or replacement (i.e., when the correction type indicates addition), the document transport control unit 133 causes the document sheet feeding part 121 to feed the current document sheet (S114). Subsequently, the document transport control unit 133 delivers the current document sheet to the document sheet ejection part 123 without performing a printing job (S115).

Subsequently, the print control unit 134 accesses the setting information and determines whether the correction type specified in the setting information indicates addition or replacement (S121).

When it is determined in the step S121 that the correction type indicates addition or replacement, the print control unit 134 causes the correction sheet feeding part 122 to feed a correction sheet (S122). Subsequently, the print control unit 134 causes the printer 13 to perform printing of the correction image data 50 stored in the RAM 112 with the correction sheet, so that the correction image data 50 is printed on the correction sheet (S123).

When a plurality of items of correction image data 50 are stored in the RAM 112, one of the plurality of correction sheets may be sequentially chosen in the order of acquisition of the items of the correction image data 50.

When the page information in the setting information indicates that both-sided printing or intensive printing is specified, the both-sided printing or the intensive printing is performed for the correction sheet by using also the image data of other pages contained in the same document sheet.

Subsequently, the print control unit 134 delivers the correction sheet on which the correction image data 50 is printed to the document sheet ejection part 123 (S124).

Subsequently, the image forming device 10 determines whether all the document sheets arranged in the document sheet feeding part 121 are processed (S125). When the result of the determination in the step S125 is negative, the control is transferred to the step S104 and the processing of the steps S104 to S124 is repeated.

After the processing of the steps S104 to S124 is completed for all the document sheets arranged in the document sheet feeding part 121, the document processing in the flowchart of FIG. 4 is terminated.

In the above-described document processing, when the correction type indicates addition, after being a correction page, the correction sheet on which the correction image data is printed is added to the location in the document sheet ejection part 123 following the document sheet of the correction page.

Alternatively, the steps S114 to S115 which are performed following the end of the step S111 in the above-described document processing may be omitted and these steps may be performed following the end of the step S124. In such a case, the correction sheet (on which the correction image data is printed) may be added to the location in the document sheet ejection part 123 corresponding to the correction page.

In the above-described image forming device 10, the setting information is acquired from the operation panel 15 or from the HDD 114. Alternatively, the image forming device 10 may be arranged so that the setting information is acquired from a PC (personal computer) connected to the image forming device 10 via a network. In such alternative embodiment, the correction image data 50 may be stored in the PC and the stored correction image data may be transmitted to the image forming device 10 via the network.

Alternatively, when a plurality of document sheets are arranged in the document sheet feeding part 121, the setting information may further include an item of information for specifying a sheet arrangement state (which is either a stacked state or a sorted state) of the document sheets arranged in the document sheet feeding part 121. In such a case, the processing of the steps S104 to S125 in the flowchart of FIG. 4 may be performed in accordance with the sheet arrangement state specified in the setting information, so that the document processing of addition, removal, or replacement is carried out.

The image forming device 10 of the above-described embodiment automatically performs the document processing of addition, removal or replacement to correct some of a plurality of document sheets in accordance with the setting information. Therefore, the document processing can be easily and efficiently performed by the image forming device 10. As a result, the repeated printing of all the document sheets after the document processing is completed can be avoided. Hence, the image forming device 10 of the above-described embodiment can promote cost reduction, resource savings, etc.

As described in the foregoing, according to the present disclosure, it is possible to easily and efficiently perform the document processing of addition, removal or replacement to correct some of a plurality of document sheets.

The present disclosure is not limited to the above-described embodiments, and variations and modifications may be made without departing from the scope of the present disclosure.

The present application is based upon and claims the benefit of priority of the prior Japanese patent application No. 2010-035174, filed on Feb. 19, 2010, the contents of which are incorporated herein by reference in their entirety.

What is claimed is:

1. An image forming device including a controller, a printer, a first sheet feeding part, a second sheet feeding part, and a document sheet ejection part, the controller comprising:

an image acquiring unit to acquire image data from a sheet that has a correction to a document;

a document transport control unit to control transporting of document sheets in the first sheet feeding part so that the document sheets are sequentially fed from the first sheet feeding part and delivered to the document sheet ejection part; and a print control unit to control, when one of the document sheets associated with a specified page is fed from the first sheet feeding part, the document transport control unit so that a sheet is fed from the second sheet feeding part to the printer, and the printing control unit causing the printer to print the image data, acquired by the image acquiring unit, on the sheet and deliver the printed sheet to the document sheet ejection part, wherein when the first sheet feeding part feeds a plurality of sets of documents the printing control causes the printer to print common image data acquired by the image acquiring unit for each of the sets of documents on a sheet fed from the second sheet feeding part for the each of the sets of documents.

2. The image forming device according to claim 1, wherein the document transport control unit delivers document sheets, other than the one of the document sheets associated with the specified correction page, which are fed from the first sheet feeding part to the document sheet ejection part.

3. The image forming device according to claim 1, wherein the image data is optically read by an image reader and acquired by the image acquiring unit.

4. The image forming device according to claim 1, wherein the image data is stored in a storage device and acquired from the storage device by the image acquiring unit.

5. The image forming device according to claim 1, wherein the document transport control unit delivers the one of the document sheets associated with the specified page, which is fed from the first sheet feeding part, to a removal sheet ejection part which is separate from the document sheet ejection part.

6. A document processing method for use in an image forming device including a controller, a printer, a first sheet feeding part, a second sheet feeding part, and a document sheet ejection part, the document processing method comprising:

acquiring image data from a sheet that has a correction to a document by an image acquiring unit of the controller;

controlling, by a document transport control unit of the controller, transporting of document sheets in the first sheet feeding part so that the document sheets are sequentially fed from the first sheet feeding part and delivered to the document sheet ejection part; and controlling, by a print control unit of the controller, when one of the document sheets associated with a specified page is fed from the first sheet feeding part, the transporting of the document sheets by the document transport control unit so that a sheet is fed from the second sheet feeding part to the printer, and the printer is caused to print the acquired image data on the sheet and deliver the printed sheet to the document sheet ejection part, wherein when the first sheet feeding part feeds a plurality of sets of documents the printing control causes the printer to print common image data acquired by the image acquiring unit for each of the sets of documents on a sheet fed from the second sheet feeding part for the each of the sets of documents.

7. The document processing method according to claim 6, wherein document sheets, other than the one of the document sheets associated with the specified correction page, which are fed from the first sheet feeding part, are delivered to the document sheet ejection part.

8. The document processing method according to claim 6, wherein the image data is optically read by an image reader and acquired in the acquiring.

9. The document processing method according to claim 6, wherein the image data is stored in a storage device and acquired from the storage device in the acquiring.

10. The document processing method according to claim 6, wherein the one of the document sheets associated with the specified page, which is fed from the first sheet feeding part, is delivered to a removal sheet ejection part which is separate from the document sheet ejection part.

11. A computer-readable recording medium storing a program which, when executed by a computer, causes the computer to perform a document processing method for use in an image forming device including a controller, a printer, a first sheet feeding part, a second sheet feeding part, and a document sheet ejection part, the document processing method comprising:

acquiring image data from a sheet that has a correction to a document by an image acquiring unit of the controller;

controlling, by a document transport control unit of the controller, transporting of document sheets in the first sheet feeding part so that the document sheets are sequentially fed from the first sheet feeding part and delivered to the document sheet ejection part; and controlling, by a print control unit of the controller, when one of the document sheets associated with a specified page is fed from the first sheet feeding part, the transporting of the document sheets by the document transport control unit so that a sheet is fed from the second sheet feeding part to the printer, and the printer is caused to print the acquired image data on the sheet and deliver the printed sheet to the document sheet ejection part, wherein when the first sheet feeding part feeds a plurality of sets of documents the printing control causes the printer to print common image data acquired by the image acquiring unit for each of the sets of documents on a sheet fed from the second sheet feeding part for the each of the sets of documents.

12. The computer-readable recording medium according to claim 11, wherein document sheets, other than the one of the document sheets associated with the specified correction page, which are fed from the first sheet feeding part, are delivered to the document sheet ejection part.

13. The computer-readable recording medium according to claim 11, wherein the image data is optically read by an image reader and acquired in the acquiring.

14. The computer-readable recording medium according to claim 11, wherein the image data is stored in a storage device and acquired from the storage device in the acquiring.

15. The computer-readable recording medium according to claim 11, wherein the one of the document sheets associated with the specified page, which is fed from the first sheet feeding part, is delivered to a removal sheet ejection part which is separate from the document sheet ejection part.

* * * * *